United States Patent [19]

Shinozawa et al.

[11] Patent Number: 4,809,529

[45] Date of Patent: Mar. 7, 1989

[54] FLARING APPARATUS FOR FLARING A RIM ELEMENT

[75] Inventors: Yusaku Shinozawa; Atuyoshi Komatu, both of Tokyo; Masahiro Okada; Hiroshi Yamada, both of Fukuoka; Masatoshi Fujita, Toyokawa, all of Japan

[73] Assignees: Topy Kogyo Kabushiki Kaisha, Tokyo; Watanabe Tekko Kabushiki Kaisha, Fukuoka, both of Japan

[21] Appl. No.: 110,346

[22] Filed: Oct. 20, 1987

[51] Int. Cl.[4] ..... B21C 51/00; B21D 53/30

[52] U.S. Cl. ..... 72/31; 72/407; 72/451; 72/416; 72/426; 29/159.01

[58] Field of Search ..... 72/407, 452, 451, 416, 72/31, 33, 426; 29/159.01, 159.1, 159 R; 413/73

[56] References Cited

U.S. PATENT DOCUMENTS

| | | | |
|---|---|---|---|
| 2,629,421 | 2/1953 | Ayres | 72/407 |
| 2,740,450 | 4/1956 | Grotnes | 72/452 |
| 3,564,898 | 2/1971 | Stettler | 72/452 |
| 3,729,795 | 5/1973 | Roper | 29/159.1 |
| 3,834,214 | 9/1974 | Kralowetz | 72/452 |

*Primary Examiner*—Daniel C. Crane
*Attorney, Agent, or Firm*—Cushman, Darby & Cushman

[57] ABSTRACT

A flaring apparatus including at least one of die member positional adjustment apparatus and a defective rim element ejecting apparatus. The positional adjustment apparatus includes a connecting shaft provided between a die member mounting block and a link mechanism for moving the mounting block. The connecting shaft has shaft portions, axes of which are radially offset from each other. By rotating the connecting shaft, the die member position can be adjusted. Therefore, there is no need to provide a shim between the die member and the mounting block. The defective rim element ejecting apparatus includes a pressure sensing switch which can detect an increase in pressure within a space defined by a rim element and the die members during flaring. When the pressure sensing switch does not detect a predetermined increase in the pressure of the space, for example, when the rim is cracked, a conveyor path device opens and the defective rim element will drop into an ejecting duct thereby ejecting the defective rim element from the manufacturing line.

13 Claims, 3 Drawing Sheets

FLARING APPARATUS FOR FLARING A RIM ELEMENT

BACKGROUND OF THE INVENTION

1. Field of the Invention:

The present invention relates to a flaring apparatus for flaring a rim element of a wheel for a vehicle. More specifically, the present invention relates to a die member position adjusting apparatus and a defective rim element ejecting apparatus for a flaring apparatus.

2. Description of the Related Art:

Vehicle wheels are conventionally manufactured on a wheel manufacture line by the following series of steps: First, a long plate of predetermined width is cut to a specified length and rolled to form a tube. The end portions of the rolled plate are then butt welded together to form a one piece cylindrical element. The cylindrical element is conveyed to a flaring apparatus where both end portions of the cylindrical element are flared by inserting die members into the cylindrical element from either side thereof. The flared element is then conveyed to a rim forming apparatus which typically comprises a plurality of rim forming machines arranged in series where each flared element is press formed to produce a desired rim configuration. The rim element is subsequently conveyed to a disk insertion station where a disk which has been formed on another manufacturing line is inserted into the rim element. The formed rim element together with the disk are then conveyed to a welding machine where they are welded together to form a disk wheel. The disk wheel is ultimately painted.

There are deficiencies, however, with the above flaring apparatus.

First, positional adjustment of the die members of the flaring machine is difficult. More particularly, in the conventional flaring machine the die members are mounted via shims on die member mounting blocks which can be driven toward or away from each other. When the type of wheel to be manufactured is changed, the die members must also be changed, since the shape, diameter, width and thickness of the rim element vary with the type of wheel to be manufactured. When the die members are changed, positional adjustment of the die members with respect to the mounting blocks is accompanied by inserting shims having various thicknesses between the die members and the mounting blocks in order to find, by trial and error, the most appropriate shim thickness. The shim having the most appropriate thickness is then fixed between the die members and the blocks. Every time a shim is inserted, the die members have to be removed from the mounting blocks. As is apparent, this process is troublesome and can take a considerable amount of time.

A second short coming with the conventional flaring apparatus is that there was no means provided for ejecting a defective rim element from the manufacturing line. More particularly, on occasion a rim element will defectively butt welded and, therefore, may break at the site of the butt weld during the flaring process. The broken rim element, if not ejected, will disadvantageously be conveyed to the next manufacturing station.

SUMMARY OF THE INVENTION

A first object of the present invention is to provide a flaring apparatus wherein it is easier to adjust the position of die members than has heretofore been possible.

A second object of the present invention is to provide a flaring apparatus wherein a defective rim element can be detected and ejected from the manufacturing line.

The first object can be attained, according to the present invention, by a die member position adjusting apparatus for a flaring apparatus wherein the end portions of a cylindrical rim element are flared by inserting die members into the end portions of the rim element, comprising: (a) a frame, (b) first and second die member mounting blocks for mounting die members, the mounting blocks being coaxial and longitudinally spaced from each other, and slidably supported by the frame so as to be horizontally movable, (c) a link mechanism for linking the mounting blocks so as to move in unison toward and away from a center of a space defined between them, (d) a driving member, connected to the link mechanism, for driving the link mechanism, (e) first and second connecting shaft, each being provided between the link mechanism and a respective mounting block, for connecting the link mechanism thereto, each connecting shaft having a first portion where the connecting shaft is rotatably connected to the respective mounting block and a second portion where the connecting shaft is rotatably connected to the link mechanism, the first and second portions of the connecting shaft being axially staggered and axes of the first and second portions of the connecting shaft being radially offset from each other, and (f) a locking/unlocking device, provided either between the connecting shaft and the mounting blocks or between the connecting shaft and the link mechanism, for locking and unlocking mutual rotation of the connecting shaft with respect to the mounting blocks or the link mechanism.

According to the above apparatus, fine positional adjustment of the die members is performed by rotating the connecting shaft, thereby eliminating the need for inserting shims between the die members and the die member mounting blocks. Accordingly, there is no need to remove the die members from the mounting blocks a number of times to find the most appropriate shim thickness. As a result, the die members only have to be removed once per change of the wheel to be manufactured.

The second object can be attained, according to the present invention, by a defective rim element ejecting apparatus which comprises: (a) a pair of die members mounted for movement toward and away from each other for flaring a rim element, the pair of die members being driven toward each other when the rim element to be flared is conveyed to a position between the die members so that the rim element end portions can be flared, (b) a pressure sensing switch connected to the closed interior space defined by the wall of rim element and the pair of die members while the rim element is being flared, (c) a conveyer path device adapted to open and close provided downstream of the die members so that flared rim elements pass through the conveyer path device when they are conveyed to a next station, (d) an opening/closing device for opening and closing the conveyer path device, the opening/closing device being electrically connected to the pressure sensing switch so that the opening/closing device closes the conveyer path device when the pressure sensing switch detects a pressure greater than a predetermined pressure during the rim flaring process and so that the opening/closing device opens the conveyer path device when the pressure sensing switch does not detect a pressure greater than the predetermined pressure during the rim flaring process, and (e) an ejecting duct, provided beneath the conveyer path device, for leading a defective rim element dropped onto the ejecting duct away from the manufacture line.

As is apparent, when the rim element that is conveyed to the flaring apparatus has a defect in the butt welded portion and the defectively butt welded portion breaks during flaring, the pressure sensing switch will not detect an increased pressure because air can escape through the crack. As a result, the conveyer path device will be opened and the defective rim element will be ejected.

BRIEF DESCRIPTION OF THE DRAWINGS

These and other objects and advantages of the invention will become more apparent and can be more readily appreciated from the following detailed description of the presently preferred exemplary embodiment of the invention taken in conjunction with the accompanying drawings, in which.

DETAILED DESCRIPTION OF THE PREFERRED EMBODIMENT

Figure 1:
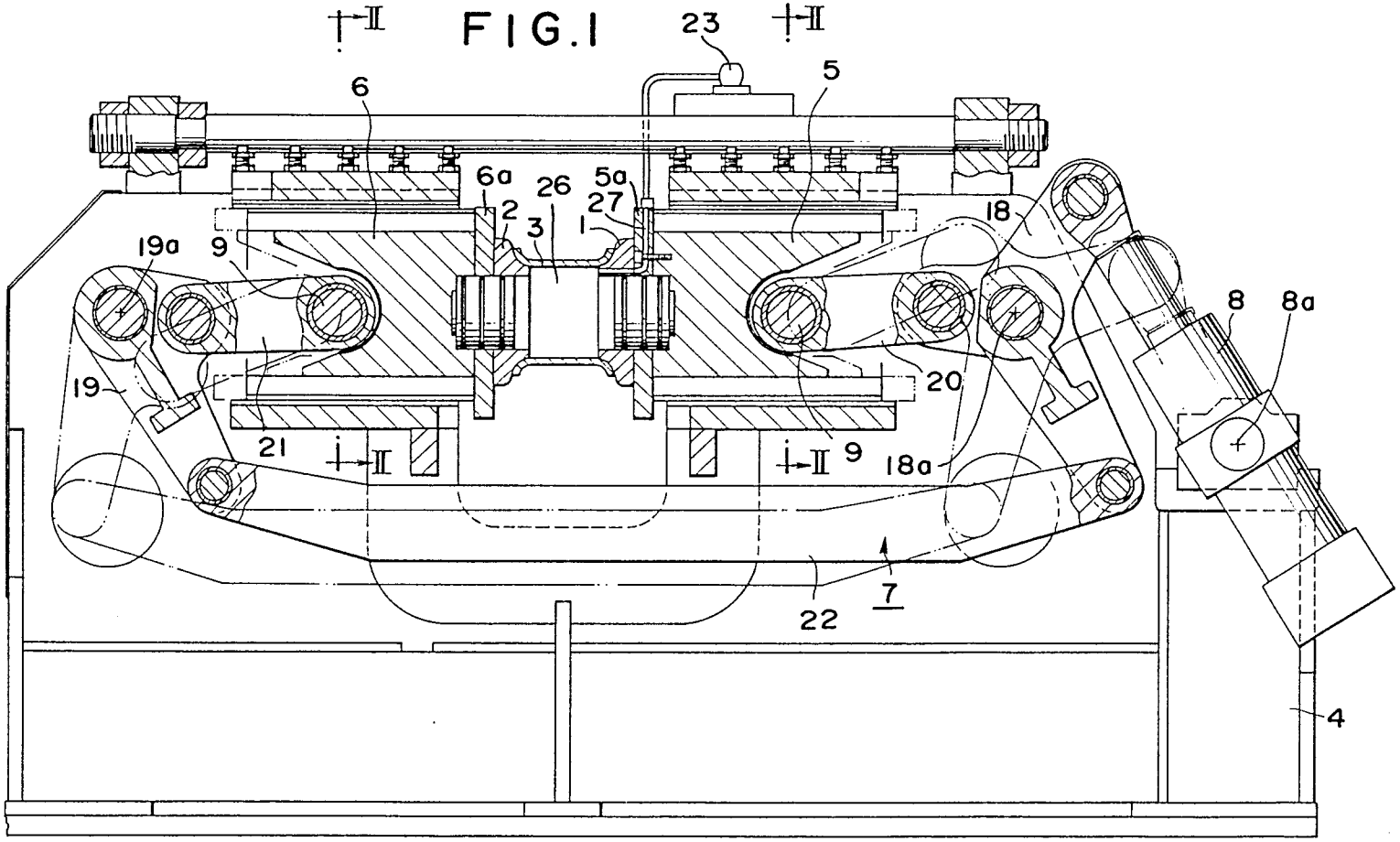
FIG. 1 is a cross-sectional view of a flaring apparatus including a positional adjustment apparatus for die members.
Figure 2:
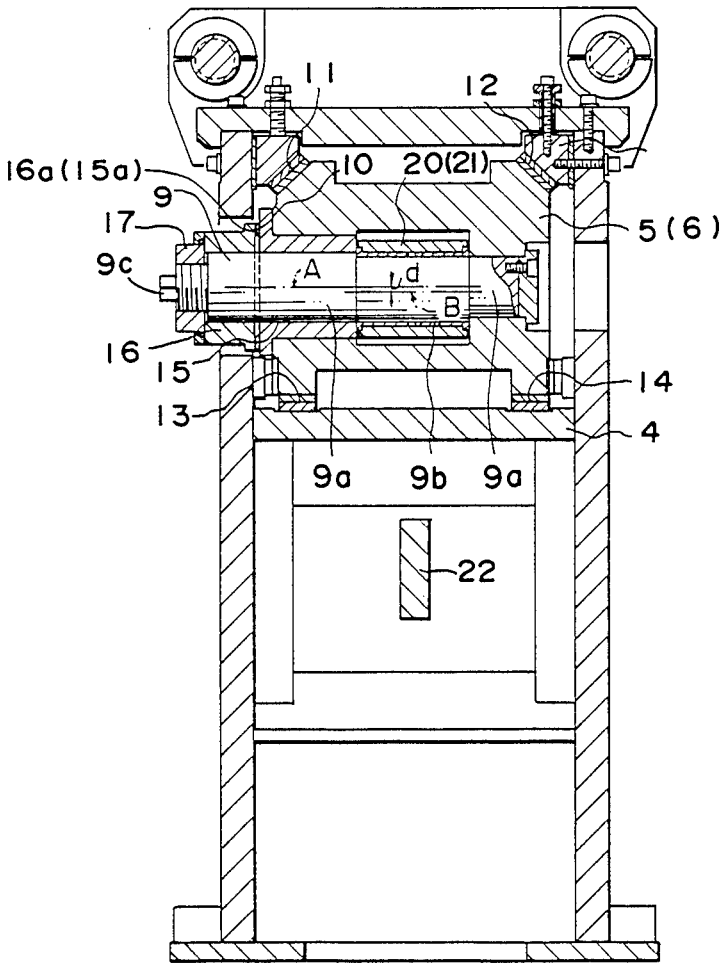
FIG. 2 is a cross-sectional view taken along line II—II of FIG. 1.
Figure 3:
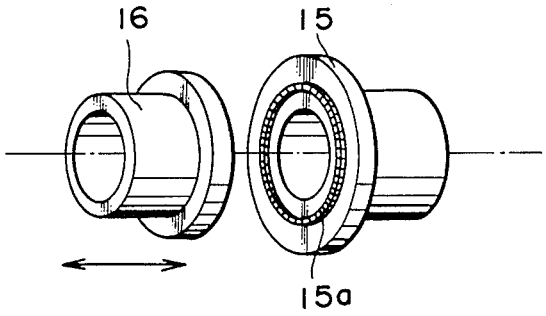
FIG. 3 is an enlarged oblique view of a locking device of the apparatus.

The flaring apparatus of the invention includes first and second die members 1 and 2 which are mounted for movement toward and away from each other. When a rim element 3 to be flared is conveyed to a position defined between die members 1 and 2 and die members 1 and 2 are inserted into respective end portions of rim element 3, the end portions of rim element 3 are flared. When the configuration of rim element 3 is to be changed so as to correspond to a change in wheel type to be manufactured, die members 1 and 2 must be exchanged since the shape, diameter, width and thickness of the rim element is changed. When die members 1 and 2 are changed, the spacing between die members 1 and 2 must be adjusted so as to correspond to the dimension of the rim element to be manufactured.

The die member position adjusting apparatus of the invention includes a frame 4, first and second die member mounting blocks 5 and 6 for mounting die members 1 and 2, respectively, a link mechanism 7 for linking mounting blocks 5 and 6, a driving device 8 for driving link mechanism 7, two connecting shafts 9 for connecting link mechanism 7 and respective mounting blocks 5 and 6, and locking/unlocking devices 10 for locking and unlocking mutual rotation of each connecting shaft 9 with either mounting blocks 5 and 6 or link mechanism 7.

Frame 4 includes a fixed frame having a U shape which opens upwardly and first and second die member mounting blocks 5 and 6 are coaxially mounted and spaced from each other. Mounting blocks 5 and 6 are slidably supported by frame 4 via slide bearings 11, 12, 13 and 14 so that mounting blocks 5 and 6 can be moved in a horizontal direction. Link mechanism 7 links mounting blocks 5 and 6 so that they move in unison toward and away from a center of a space defined between them. The driving device for driving link mechanism 7 includes a hydraulic cylinder 8 which is connected to link mechanism 7.

As was stated above, each connecting shaft 9 is provided between link mechanism 7 and a respective mounting block 5, 6. More particularly, connecting shaft 9 includes a first portion **9*a* where connecting shaft 9 is rotatably connected to, for example, mounting block 5, (6) and a second portion 9*b* where connecting shaft 9 is rotatably connected to link mechanism 7. First and second portions 9*a* and 9*b* of connecting shaft 9 are axially staggered and the longitudinal axes A and B of first and second portions 9*a* and 9*b* are radially offset from each other by a distance d. The distance between die members 1 and 2 changes corresponding to the change in longitudinal lengths of substitute die members 1 and fine adjustment of the distance between the substitute die members 1 and 2 are performed by rotation of connecting shaft 9. Usually, the width (axial length) of a wheel rim changes 140–280 mm corresponding to change in the type of wheel to be manufactured. The change in the length of the substitute die member roughly absorbs the wheel rim width change and the amount to be finely adjusted is usually less than 10 mm. When distance d between axes A and B is 5 mm, the distance between the substitute die members can be adjusted within the range of −10 mm–+10 mm. Die members 1 and 2 are mounted on die member mounting blocks 5 and 6**, respectively, without interposing a shim therebetween.

Locking/unlocking device 10 is provided either between connecting shaft 9 and its respective mounting block or between connecting shaft 9 and link mechanism 7. In the embodiment shown in FIG. 1, locking/unlocking device 10 is provided between connecting shaft 9 and respective first and second die member mounting blocks 5 and 6.

Locking/unlocking device 10 includes a cylindrical member 15, a locking ring 16 and a lock nut 17. Cylindrical member 15 is fixed to a respective mounting block 5, 6 and has a first circumferentially extending toothed surface **15*a* at one end thereof. Lock ring 16 is mounted on connecting shaft 9 so as to be axially slidable but rotationally fixed with respect thereto. Lock ring 16 also has a second circumferentially extending toothed surface 16*a* at one end thereof in facing relation to cylindrical member 15 so that when lock ring 16 is moved toward and away from cylindrical member 15, toothed surface 16*a* is engaged and disengaged respectively with toothed surface 15*a* Lock nut 17 is threadingly engaged with connecting shaft 9 at one end portion of connecting shaft 9 such that when lock nut 17 is tightened, lock ring 16 is pushed toward cylindrical member 15 so that toothed surfaces 15*a* and 16*a* are engaged with each other. When lock nut 17 is loosened, lock ring 16 can be moved away from cylindrical member 15 so that toothed surfaces 15*a* and 16*a* are disengaged from each other. Connecting shaft 9 includes a protrusion 9*c* having a square cross-section where a connecting shaft rotating handle (not shown) can be mounted. When connecting shaft 9 is rotated for the purpose of adjusting positions of die member mounting blocks 5 and 6**, the connecting shaft rotating handle is mounted on protrusion 9c and connecting shaft 9 is manually rotated.

Link mechanism 7 comprises first and second swaying members 18 and 19, first and second pushing members 20 and 21, and one connecting member 22. First and second swaying members 18 and 19 are pivotally connected to frame 4 at pivot axes 18a and 19a, respectively. First and second pushing members 20 and 21 are pivotally connected to first and second swaying members 18 and 19, respectively, at first end portions thereof and rotatably connected via connecting shaft 9 to first and second die member mounting blocks 5 and 6, respectively, at second end portions thereof. Connecting member 22 is pivotally connected to and interconnects swaying members 18 and 19. The cylinder portion of hydraulic cylinder 8 is pivotally connected to frame 4 at a pivot axis 8a and the rod portion of hydraulic cylinder 8 is pivotally connected to either one of swaying members 18 and 19.

Figure 4:
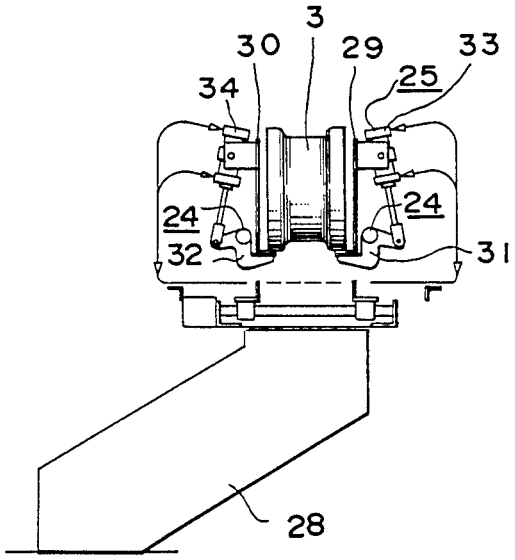
FIG. 4 is a cross-sectional view of a defective rim element ejecting apparatus for the flaring apparatus.

Referring now to FIG. 4, the defective rim element ejecting apparatus includes a pressure sensing switch 23, a conveyer path device 24 which can open and close, an opening/closing device 25 for opening and closing conveyer device 24, and an ejecting duct 28. When the pair of die members 1 and 2 are inserted into the end portions of rim element 3, the die members 1 and 2 and rim element 3 define a closed space 26. An air path 27 is formed in either one of members 5a and 6a which are portions of blocks 5 and 6 and pressure sensing switch 23 is connected through air path 27 to closed space 26. Conveyer path device 24 is provided downstream of the forming position of the flaring apparatus so that rim element 3, already flared, passes through conveyer path device 24 when rim element 3 is conveyed to the next station. Conveyer path device 24 comprises a pair of path guides 29 and 30 for guiding rim element 3 in a width direction and a pair of arms 31 and 32 pivotally connected to path guides 29 and 30, respectively.

Opening/closing device 25 is electrically connected to pressure sensing switch 23 so that device 25 closes conveyer path device 24 when pressure sensing switch 23 detects a pressure in space 26 greater than a predetermined pressure during the flaring of rim element 3 and so that opening/closing device 25 opens conveyer path device 24 when pressure sensing switch 23 does not detect a pressure greater than the predetermined pressure. Opening/closing device 25 comprises a pair of air cylinders 33 and 34. Cylinder portions of air cylinders 33 and 34 are pivotally connected to path guides 29 and 30, respectively, and rod portions of air cylinders 33 and 34 are pivotally connected to arms 31 and 32, respectively.

Ejecting duct 28 is provided beneath conveyer path device 24. Ejecting duct 28 leads a defective rim element dropped onto ejecting duct 28 away from the wheel manufacturing line.

The operation of the flaring apparatus of the present invention is as follows:

When rim element 3 is conveyed to the flaring apparatus, die members 1 and 2 are driven so as to be inserted into the end portions of rim element 3 and rim element 3 is flared. When rim element 3 is being flared, closed space 26 will increase in pressure because of the insertion of die members 1 and 2, if the butt welded portion of rim element 3 has no crack. However, if there is a crack in the butt welded portion which penetrates the wall of rim element 3, there will only be a small increase in the pressure of closed space 26 because air can escape through the crack. When pressure sensing switch 23 does not detect a pressure increase, opening/closing device 25 opens the conveyer path device 24. Thus, a defective rim element 3 which has been flared, when conveyed to the next forming station, will drop down into and be ejected away from the manufacturing line. When flared rim element 3 has no defect, however, it passes through the closed conveyer path device 24 and is conveyed to the next station. Since defective rim elements are ejected, efficiency of wheel manufacture is increased.

When the type of wheel to be manufactured is changed, die members 1 and 2 are exchanged. After replacement die members 1 and 2 are mounted on die member mounting blocks 5 and 6, the position of die members 1 and 2 are adjusted by rotating connecting shafts 9. During the adjustment, locking device 10 is unlocked. Due to the rotation of connecting shaft 9, die member mounting blocks 5 and 6 are moved toward and away from each other so that positions of die members 1 and 2 are adjusted to the desirable positions, respectively. This positional adjustment does not need any shim and, accordingly, the positional adjustment of die members 1 and 2 is very easy.

Although only one embodiment of the present invention has been described in detail above, it will be appreciated by those skilled in the art that various modifications and alterations can be made to the particular embodiment shown without materially departing from the novel teachings and advantages of the present invention. Accordingly, it is to be understood that all such modifications and alterations are included within the spirit and scope of the present invention as defined by the following claims.

What is claimed is:

1. A die member position adjusting apparatus for a flaring machine wherein the end portions of a cylindrical rim element are flared by inserting die members into said end portions, comprising:

a frame;

first and second die member mounting blocks for mounting first and second die members, respectively, said mounting blocks being provided coaxial and longitudinally spaced from one another, and being slidably supported so as to be movable in a longitudinal direction thereof;

a link mechanism for linking said first and second die member mounting blocks so that said mounting blocks move in unison toward and away from one another;

driving means, connected to said link mechanism, for driving said link mechanism so that said first and second die members, when moved toward one another, flare a rim element;

first and second connecting shafts, each provided between a respective mounting block and said link mechanism, for connecting said link mechanism and said mounting blocks, each said connecting shafts having a first portion where said connecting shaft is rotatably connected to a said mounting block and a second portion where said connecting shaft is rotatably connected to said link mechanism, said first and second portions being axially staggered and longitudinal axes of said first and second portions being radially offset from each other; and locking/unlocking means, provided between a said connecting shaft and a respective mounting block, for locking and unlocking mutual rotation of said connecting shaft with respect to said respective mounting block, said locking/unlocking means including:

a cylindrical member fixed to said respective mounting block, said cylindrical member having a first circumferentially extending toothed surface at one end thereof;

a lock ring mounted on said connecting shaft so as to be axially slidable but rotationally fixed, said lock ring having a second circumferentially extending toothed surface at one end thereof in facing relation to said cylindrical member such that when said lock ring is moved toward and away from said cylindrical member, said second toothed surface is engaged and disengaged, respectively, with said first toothed surface; and a lock nut provided between said lock ring and said connecting shaft and threadably engaged with said connecting shaft that when said lock nut is tightened, said lock ring is pushed toward said cylindrical member so that said first and second toothed surface are engaged with each other, whereas when said lock nut is loosened, said lock ring can be moved away rom said cylindrical member so that said first and second toothed surfaces are disengaged from each other.

2. The apparatus according to claim 1, wherein each said die members is directly mounted on a respective said mounting block.

3. The apparatus according to claim 1, wherein said connecting shaft includes a protrusion to which a connecting shaft rotating handle can be mounted.

4. The apparatus according to claim 1, wherein said link mechanism comprises:

first and second swaying members pivotally supported by said frame;

first and second pushing members pivotally connected to said first and second swaying members, respectively, at first end portions thereof and rotatably connected via said connecting shaft to said first and second die member mounting blocks, respectively, at second end portions thereof; and a connecting member, pivotally connected to said first and second swaying members, for connecting said first and second swaying members.

5. The apparatus according to claim 4, wherein said driving device comprises a hydraulic cylinder, a cylinder portion of said hydraulic cylinder being pivotally connected to said frame and a rod portion of said hydraulic cylinder being pivotally connected to one of said first and second swaying members.

6. A defective rim element ejecting apparatus for a flaring apparatus with a die member position adjusting apparatus, for flaring end portions of a rim element, comprising:

a pair of die members mounted so as to be movable toward and away from each other for flaring a rim element, said die members being driven toward each other when a rim element is conveyed to a position defined between said die members so that insertion of said die members into the end portions of said rim element flares said end portions;

said die members being adjustable in position by means of a die member position adjusting apparatus which includes;

a frame;

first and second die member mounting blocks for mounting first and second die members, respectively, said mounting blocks being provided coaxial and longitudinally spaced from one another, and being slidably supported so as to be movable in a longitudinal direction thereof;

a link mechanism for linking said first and second die member mounting blocks so that said mounting blocks move in unison toward and away from one another;

driving means, connected to said link mechanism, for driving said link mechanism so that said first and second die members, when moved toward one another, flare a rim element;

first and second connecting shafts, each provided between a respective mounting block and said link mechanism, for connecting said link mechanism and said mounting blocks, each said connecting shafts having a first portion where said connecting shaft is rotatably connected to a said mounting block and a second portion where said connecting shaft is rotatably connected to said link mechanism, said first and second portions being axially staggered and longitudinal axes of said first and second portions being radially offset from each other; and locking/unlocking means, provided at one of between a said connecting shaft and a respective mounting block and between a said connecting shaft and said link mechanism, for locking and unlocking mutual rotation of said connecting shaft with respect to one of said respective mounting block and said link mechanism, said link mechanism including:

first and second swaying members pivotally supported by said frame;

first and second pushing members pivotally connected to said first and second swaying members, respectively, at first end potions thereof and rotatably connected via said connecting shaft to said first and second die member mounting blocks, respectively, at second end portions thereof; and a connecting member, pivotally connected to said first and second swaying members, for connecting said first and second swaying members, a pressure sensing switch operatively coupled to a space defined by said rim element and said die members when said rim element is being formed;

a conveyor path device adapted to be opened and closed and provided downstream of said flaring apparatus so that a flared rim element passes therethrough when said flared rim element is conveyed to a next station;

an opening/closing device for opening and closing said conveyor path device, said opening/closing device being electrically coupled to said pressure sensing switch so that said opening/closing device closes said conveyor path device when said pressure sensing switch detects a pressure in said space greater than a predetermined pressure during the flaring of said rim element and so that said opening/closing device opens said conveyor path device when said pressure sensing switch does not detect a pressure greater than the predetermined pressure during the flaring of said rim element; and an ejecting duct, mounted below said conveyor path device, for conducting a defective rim element dropped onto said ejecting duct away from the wheel manufacturing line.

7. The apparatus according to claim 6, wherein said conveyer path device comprises:

a pair of path guides for guiding said flared rim element already flared in a width direction thereof; and a pair of arm elements each pivotally connected to a respective path guide.

8. The apparatus according to claim 7, wherein said opening/closing device comprises a pair of air cylinders, a cylinder portion of each said air cylinders being pivotally connected to a respective path guide and a rod portion of each said air cylinders being pivotally connected to a respective arm element.

9. A die member position adjusting apparatus for a flaring machine wherein the end portions of a cylindrical rim element are flared by inserting die members into said end portions, comprising:

a frame;

first and second die member mounting blocks for mounting first and second die members, respectively, said mounting blocks being provided coaxial and longitudinally spaced from one another, and being slidably supported so as to be movable in a longitudinal direction thereof;

a link mechanism for linking said first and second die member mounting blocks so that said mounting blocks move in unison toward and away from one another;

driving means, connected to said link mechanism, for driving said link mechanism so that said first and second die members, when moved toward one another, flare a rim element;

first and second connecting shafts, each provided between a respective mounting block and said link mechanism, for connecting said link mechanism and said mounting blocks, each said connecting shafts having a first position where said connecting shaft is rotatably connected to a said mounting block and a second portion where said connecting shaft is rotatably connected to said link mechanism, said first and second portions being axially staggered and longitudinal axes of said first and second portions being radially offset from each other; and locking/unlocking means, provided at one of between a said connecting shaft and a respective mounting block and between a said connecting shaft and said link mechanism, for locking and unlocking mutual rotation of said connecting shaft with respect to one of said respective mounting block and said link mechanism, said link mechanism including:

first and second swaying members pivotally supported by said frame;

first and second pushing members pivotally connected to said first and second swaying members, respectively, at first end portions thereof and rotatably connected via said connecting shaft to said first and second die member mounting blocks, respectively, at second end portions thereof; and a connecting member, pivotally connected to said first and second swaying members, for connecting said first and second swaying members.

10. The apparatus according to claim 9, wherein each said die member is directly mounted on a respective said mounting block.

11. The apparatus according to claim 9, wherein said locking/unlocking means are provided between each said connecting shaft and a respective said mounting block.

12. The apparatus according to claim 9, wherein said connecting shaft includes a protrusion to which a connecting shaft rotating handle can be mounted.

13. The apparatus according to claim 9, wherein said driving device comprises a hydraulic cylinder, a cylinder portion of said hydraulic cylinder being pivotally connected to said frame and a rod portion of said hydraulic cylinder being pivotally connected to one of said first and second swaying members.

* * * * *